US008347801B2

(12) United States Patent
Denise

(10) Patent No.: US 8,347,801 B2
(45) Date of Patent: Jan. 8, 2013

(54) FLOATING SUPPORT FOR OIL PRODUCTION FITTED WITH PACK ICE DESTRUCTION DEVICES, AND AN ASSOCIATED METHOD

(75) Inventor: Jean-Paul Denise, Hyeres (FR)

(73) Assignee: Saipem S.A., Montigny le Bretonneux (FR)

( * ) Notice: Subject to any disclaimer, the term of this patent is extended or adjusted under 35 U.S.C. 154(b) by 163 days.

(21) Appl. No.: 12/747,122

(22) PCT Filed: Nov. 17, 2008

(86) PCT No.: PCT/FR2008/052064

§ 371 (c)(1),
(2), (4) Date: Oct. 14, 2010

(87) PCT Pub. No.: WO2009/074759

PCT Pub. Date: Jun. 18, 2009

(65) Prior Publication Data

US 2011/0017118 A1 Jan. 27, 2011

(30) Foreign Application Priority Data

Dec. 10, 2007 (FR) ..... 07 59681

(51) Int. Cl.
*B63B 35/08* (2006.01)

(52) U.S. Cl. ..... 114/40

(58) Field of Classification Search ..... 114/40, 114/41, 42, 43, 264; 405/211
See application file for complete search history.

(56) References Cited

U.S. PATENT DOCUMENTS

| | | | | |
|---|---|---|---|---|
| 3,468,277 | A | 9/1969 | Rosner et al. | |
| 3,759,046 | A * | 9/1973 | Anders | 405/211 |
| 3,973,509 | A * | 8/1976 | Waas | 114/42 |
| 4,070,062 | A | 1/1978 | Morgan et al. | |
| 4,077,225 | A * | 3/1978 | Lichtenberger et al. | 405/211 |
| 4,152,999 | A * | 5/1979 | Oshima et al. | 114/42 |
| 6,811,355 | B2 * | 11/2004 | Poldervaart | 114/230.1 |

FOREIGN PATENT DOCUMENTS

| | | |
|---|---|---|
| DE | 4139544 | 6/1993 |
| WO | WO 2007/136273 | 11/2007 |

OTHER PUBLICATIONS

International Search Report dated Apr. 29, 2009.

* cited by examiner

*Primary Examiner* — Lars A Olson
(74) *Attorney, Agent, or Firm* — Cozen O'Connor

(57) ABSTRACT

A floating support for off-shore oil production in an arctic or antarctic zone, the support being fitted under its hull with a disconnectable turret from which there extend anchor lines connected to the sea bottom and bottom-to-surface connection pipes. The hull including lateral sides extending in its longitudinal direction. The longitudinal lateral sides of the support carry respective pluralities of devices for localized destruction of pack ice, each device having a destruction tool having at least one pointed portion suitable for breaking pack ice by repeated actuation in vertical pivoting and/or translation of the tool relative to the side, the point, on moving downwards, thus bearing in localized manner against the surface of the pack ice with a force that is preferably at least 10,000 kN. The tool being actuated in pivoting and/or translation with the help of a pivoting and/or translation guide structure applied against the side of the support.

14 Claims, 6 Drawing Sheets

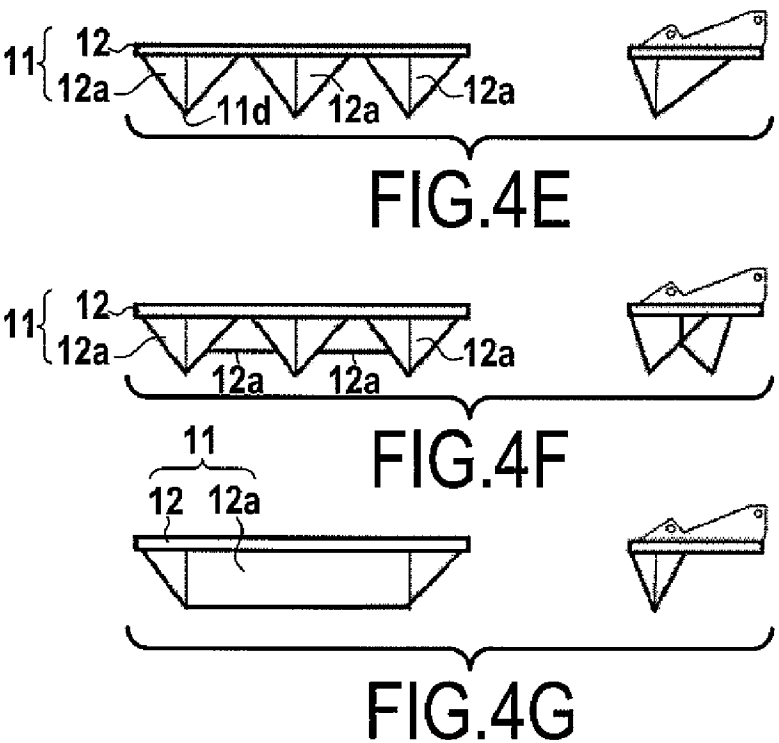
FIG.4E
FIG.4F
FIG.4G
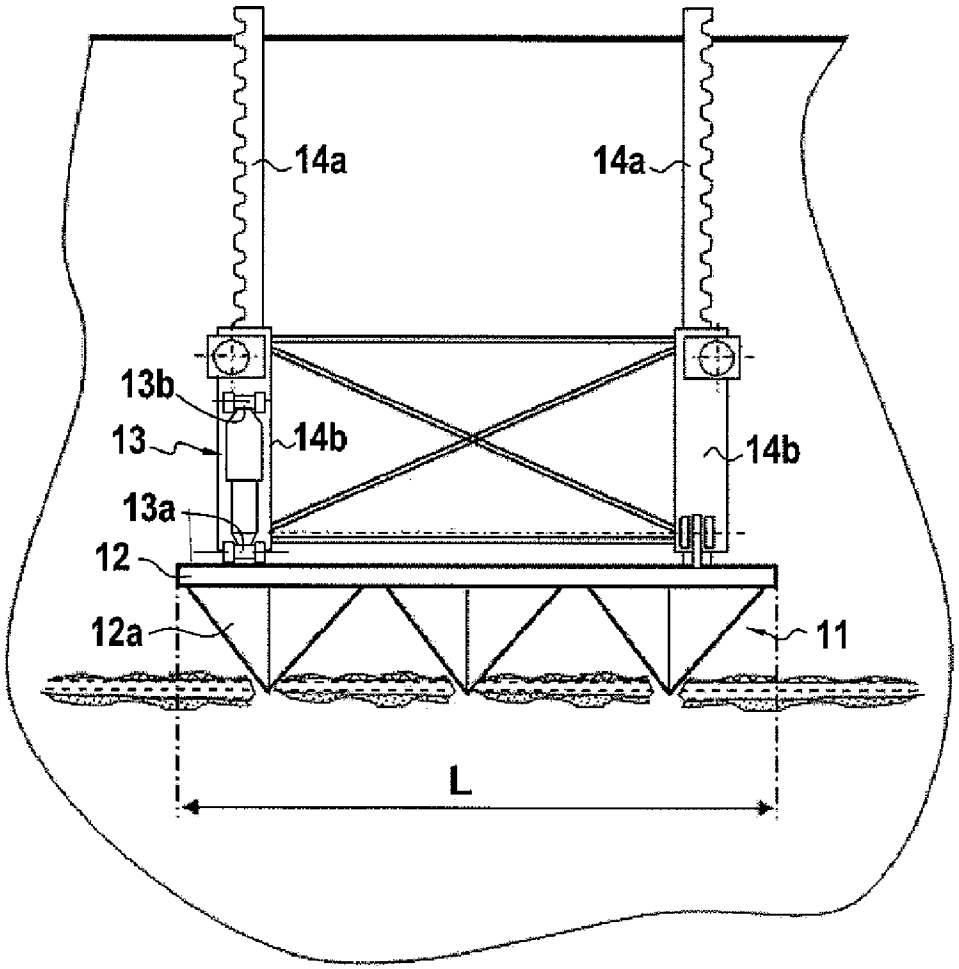
FIG.4A

FLOATING SUPPORT FOR OIL PRODUCTION FITTED WITH PACK ICE DESTRUCTION DEVICES, AND AN ASSOCIATED METHOD

PRIORITY CLAIM

This is a U.S. national stage of application No. PCT/FR2008/052064, filed on Nov. 17, 2008. Priority is claimed on the following application: France Application No.: 0759681 Filed on Dec. 10, 2007, the content of which is incorporated here by reference.

FIELD OF THE INVENTION

The present invention relates to a floating support fitted with at least one device for localized destruction of pack ice so as to prevent the floating support from coming directly into contact with said pack ice, and thus running the risk of becoming locked in the ice.

The technical field of the invention is more particularly the field of off-shore oil production in Arctic and Antarctic zones, from floating supports.

A floating support for oil production generally comprises anchor means to enable it to remain in position in spite of the effects of currents, winds, and swell. In general it also includes means for drilling, storing, and processing oil and means for off-loading to oil off-loaders that call at regular intervals to take the production away. Such floating supports or ships are commonly referred to as floating production storage off-loading vessels, referred to throughout the description below by the abbreviation FPSO, or else as floating drilling and production units (FDPU) when the floating support is also used for performing drilling operations with wells that are deviated in the depth of water.

When weather and sea conditions, i.e. swell, wind, and current, are severe or even extreme, as during storms, it is preferred for an FPSO to be anchored via a turret, which is generally situated in conventional manner in the front half of the ship and on its axis, so that the ship is free to turn about said turret to face the wind, the current, and the swell. Thus, since wind, current, and swell exert specific forces on its hull and superstructures, the FPSO make use of its degree of freedom to pivot about the vertical axis ZZ and naturally takes up a position of least resistance. The pipes providing the connection with the well heads are generally connected to the underside of the turret and they are connected to the FPSO via a rotary joint incorporated on the axis of said turret. Where weather conditions might become extreme, as applies in the North Sea, in the Gulf of Mexico, or in the arctic, an FPSO is generally made to be disconnectable so that it can take shelter while waiting for acceptable operating conditions to return.

The present invention relates more particularly to a floating support for off-shore oil production in Arctic or Antarctic zones, which support is fitted on the underside of its hull with a disconnectable turret from which anchor lines extend to the bottom of the sea together with bottom-surface connection pipes, said hull including lateral sides extending in its longitudinal direction, which sides are substantially plane and vertical, and said hull possibly including in known manner at its bow (front portion of the ship) and preferably at its stern (rear portion of the ship) portions that are inclined relative to the horizontal and preferably shaped to form a reinforced pointed stem suitable for breaking ice merely by bending when pack ice forces itself under said reinforced stem.

BACKGROUND OF THE INVENTION

Floating supports advantageously present a hull with longitudinal sides that are substantially vertical in order to optimize oil storage capacity, and also to give better behavior in rough seas. However a hull with vertical sides is particularly disadvantageous in terms of its behavior when faced with pack ice. Thus, proposals are made in U.S. Pat. Nos. 4,102,288 and 4,571,125 for floating supports that present, amongst other means, sides with profiles that are curved or inclined in order to facilitate ice-breaking, in the manner of profiles that are known for the bow of the ship with a stem that is inclined relative to the horizontal.

Patent application WO-2007/089152 describes an oil field development ship anchored on a turret, with vertical sides similar to those commonly used in the North Sea or in the Gulf of Mexico, and possessing pack ice destruction means constituted by cutter devices based on using high-power rotary tools that move on guide means installed along the sides of the ship, so as to eliminate progressively the pack ice that is close to said ship. Such devices are extremely expensive to make and difficult to implement since they need to be operated at high levels of power and over the full thickness of the pack ice, and thus at the end of an arm that needs to be extremely rigid, and furthermore underwater for much of the time, since said pack ice presents a thickness that may be as much as several meters in certain locations.

The problem of the present invention is to provide an improved solution, in particular a solution that is simpler and less expensive to implement and to provide, and above that is more effective in destroying pack ice, the solution being suitable for large-capacity oil production floating supports and in particular those that have vertical sides, the solution preventing the pack ice from blocking and damaging a ship that is anchored on a turret, such as FPSO, when the ship moves in compliance with wind and current.

SUMMARY OF THE INVENTION

For this purpose, the present invention provides a floating support for off-shore oil production in an arctic or antarctic zone, the support being fitted under its hull with a disconnectable turret from which there extend anchor lines connected to the sea bottom and bottom-to-surface connection pipes, said hull including lateral sides extending in its longitudinal direction, which sides are preferably substantially plane and vertical, except possibly at the waterline, the support being characterized in that said longitudinal lateral sides carry respective pluralities of devices for localized destruction of pack ice, each device comprising a destruction tool having at least one pointed portion suitable for breaking pack ice by repeated actuation in vertical pivoting and/or translation of said tool relative to said side, said point, on moving downwards, thus bearing in localized manner against the surface of the pack ice with a force that is preferably at least 10,000 kilonewtons (kN), said tool being actuated in pivoting and/or translation with the help of a pivoting and/or translation guide structure applied against the side of the support.

When the pack ice destruction device is operated to destroy the pack ice locally, it exerts a large force thereon and it is the ship that needs to constitute the bearing point at the reaction fixed point, thus representing a force of several thousands of metric tonnes, as explained below. The multiplicity of pack ice destruction devices of the present invention makes it possible to implement the devices individually and separately, preferably in succession along the longitudinal direction of a side, so as to limit unbalance of the floating support as might result from excessive force being developed by actuating a plurality of pack ice destruction devices simultaneously on the side of the support that is facing the pack ice.

Preferably, the floating support of the invention includes a multiplicity of destruction devices on both of its longitudinal sides, the devices being juxtaposed side by side over substantially the entire length of said sides.

The present invention also provides a method of destroying pack ice using a floating support of the invention, the method being characterized in that the various destruction devices along the length of the sides facing the advancing pack ice are actuated, and the various destruction devices disposed side by side are preferably actuated successively one after another in the go and return directions sequentially along the length of the side facing the advancing pack ice.

Requirements in terms of mechanical, hydraulic, or electrical power are considerably reduced by actuating the multiple destruction devices in sequential manner.

When the ship is moored via its turret, the ship naturally presents its bow to face the advancing pack ice head-on, thereby enabling said pack ice to be destroyed as a result of the ice-breaker shape of the bow. However, if the direction of advance of the pack ice changes direction suddenly, e.g. through 45° or 90°, then the advancing pack ice comes directly into contact with the longitudinal side of the ship and requires the destruction means described in the present application to be used so as to enable the ship to return to its head-on position facing the new direction of advance of the pack ice.

Also preferably, said floating support is fitted with azimuth thrusters and with bow thrusters that are used to cause the floating support to turn so that it takes up a position facing the advancing pack ice head-on once sufficient pack ice has been destroyed with said destruction devices to enable the floating support to be received in the channel thus created.

Also preferably, the jets of sea water produced by the azimuth thrusters and by the bow thrusters are used in known manner to move away the blocks of pack ice as broken up by the device of the invention.

In a preferred embodiment of the floating support of the present invention, the destruction tool is easy to actuate and more effective in striking and breaking ice by impact and by bending, while also limiting the reaction unbalance of the floating support or ship when said destruction tool is actuated in pivoting for the purpose of destroying the pack ice.

Thus, in a preferred embodiment of the invention, said pack ice destruction device comprises means for guiding and moving the destruction tool in vertical translation over the height of the side between a high, storage position above the level of pack ice and a low, working position immediately above the level of pack ice, and means for actuating downward and upward pivoting of the destruction tool between the surface of the side and the surface of the pack ice so that pivoting of said tool enables it to reach a sufficient depth to pass through the entire thickness of the pack ice, at least after a series of repeated downward and upward actuations in pivoting.

Also preferably, actuating said destruction tool enables a force of at least 1000 kN, more particularly of 1000 kN to 50,000 kN, preferably at least equal to 10,000 kN to be applied to the surface of the pack ice and enables the pack ice to be broken over its entire thickness by bending over a length lying in the range 3 meters (m) to 15 m, and preferably in the range 5 m to 10 m. It is known how to construct reliable rigid metal structures that enable such forces to be exerted at such a distance.

In a particular embodiment, the destruction tool comprises a rigid platform extending longitudinally and substantially horizontally along the side of the support over a length lying in the range 3 m to 15 m, preferably in the range 5 m to 10 m, and having a width of 2 m to 5 m, and supporting on its underface a plurality, preferably two to five, of said pointed rigid structures disposed side by side and secured to said platform, said platform preferably being constituted by a steel plate or a framework of girders.

In another particular embodiment, said pointed structure(s) is/are pointed structures constituted by steel plates, preferably of thickness lying in the range 30 millimeters (mm) to 60 mm, disposed at an angle relative to one another of 30° to 120°, and preferably of 60° to 90°.

Still more particularly, said pointed structure is constituted by three or four steel plates disposed as a trihedron or a pyramid, preferably with internal reinforcing elements such as connection elements of the metal strut type between plates.

Still more particularly, said pointed structure is constituted by two rectangular steel plates disposed at an angle one against the other, preferably with internal reinforcing elements such as connection elements of the metal strut type between the plates. Said point may extend parallel with or perpendicular to the longitudinal direction of the side, or indeed it may extend in an inclined direction.

In a preferred embodiment, said pack ice destruction device includes a guide structure for guiding the destruction tool in translation and in pivoting, the guide structure comprising at least one carriage, suitable for moving vertically in translation along at least one guide rail, said carriage supporting at least one actuator, more preferably a hydraulic actuator, with the end of the actuator cylinder being pivotally hinged to said carriage, said tool being supported and pivotally hinged firstly to said carriage, and secondly to the end of the actuator rod, such that said tool may be stored together with the carriage in a high position above the level of the pack ice, said actuator being in a retracted position and said carriage being capable of being moved down in translation to a low position, and preferably of being blocked in a working position immediately above the level of the pack ice so that extending said actuator causes said destruction tool to pivot, said point(s) being capable of reaching a sufficient depth to pass through the entire thickness of the pack ice when the actuator rod is fully extended.

More particularly, said carriage includes gearing driven by an electric or hydraulic motor and co-operating with a guide rail of the rack type.

Still more particularly, said destruction device has two guide rails extending vertically and in parallel over the height of the side from above the deck of the floating support to immediately above the level of the pack ice, the rails preferably being spaced apart by 3 m to 10 m, each guiding a motor-driven carriage, the base of the carriage having pivotally hinged thereto a said platform on its longitudinal side closest to said side of the support, and a high portion having the end of a hydraulic actuator cylinder pivotally hinged thereto, the end of the actuator rod being pivotally hinged to said platform, preferably close to the side of the platform that is furthest from said side of the support.

BRIEF DESCRIPTION OF THE DRAWINGS

Other aspects of the problem, and the characteristics and advantages of the present invention appear more clearly in the light of the following detailed description made by way of non-limiting illustration and with reference to the accompanying drawings, in which:

FIG. 4A is a face view of a device for destroying pack ice of the invention as shown in FIG. 4;

FIGS. 4E to 4G are face views and end views of various pack-ice destruction tools having point structures as implemented in a pack-ice destruction device of the invention.

DETAILED DESCRIPTION OF THE PRESENTLY PREFERRED EMBODIMENTS

Figure 1:
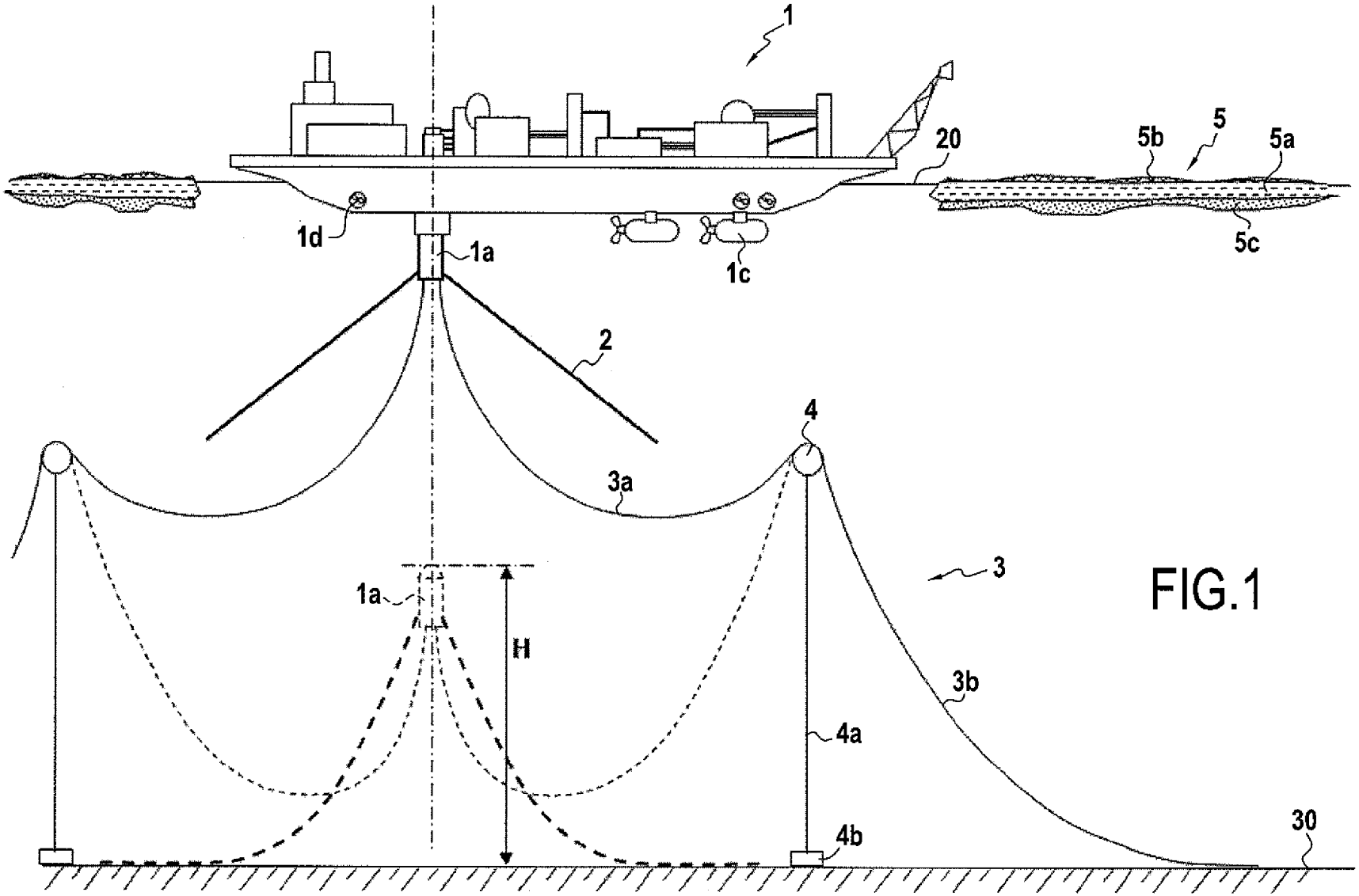
FIG. 1 is a side view, partially in section, of an FPSO anchored on a turret within pack ice.

FIG. 1 is a side view, partially in section, of an FPSO type floating support or ship 1 anchored on a disconnectable turret 1*a* that is anchored by anchor lines 2 and connected to undersea well heads (not shown) by flexible pipes 3 in a dipping catenary configuration 3*a* down to a sub-surface float 4 supporting said flexible pipe, said float being held by a cable 4*a* that is connected to a deadman 4*b* on the sea bottom, with said flexible pipes 3 then continuing in a catenary configuration 3*b* down to the sea bottom 30, and then along the bottom to said well head. The FPSO is in cold waters in which icebergs or pack ice 5 of large area and considerably thickness move. The pack ice is generally constituted by frozen and consolidated sea water 5*a* of thickness that varies over the range a few tens of centimeters to several meters. From one year to another, pack ice forms from broken sheet ice associated with frozen spray that accumulates in the cold season, thereby consolidating pieces of ice to form ice ridges. Pack ice thus comprises a consolidated central portion referred to as level ice that is surmounted by a top portion referred to as a "sail" and a bottom, in the water, referred to as a "keel". When pack ice persists from one year to another, its thickness and its compactness increase as does the difficulty of breaking it in order to release a passage for ships.

With pack ice that is too thick to be destroyed by an icebreaker ship, or by the pack ice destruction devices of the invention as described below, or when a storm is forecast, the FPSO may be disconnected in order to take shelter in a port or in a calm zone, and for this purpose, in known manner, the bottom portion of the turret 1*a* carrying the anchors and the connecting flexible pipes is separated from the FPSO and lowered towards the bottom by a cable (not shown) where it is abandoned. Since said bottom portion of the turret 1*a* presents positive buoyancy, it goes down to a depth such that the weight of the anchor lines it is carrying above the bottom plus the weight of the flexible pipe comes into equilibrium very exactly with its buoyancy. This means that the abandoning stage can be performed extremely quickly and requires very few precautions, the bottom portion of the turret, the anchor lines, and the flexible pipes then occupying a predetermined depth, e.g. 100 m beneath the surface, with said depth and thus the distance H to the sea bottom being predetermined by the buoyancy of said bottom portion of the turret and also by the configuration of the system of anchors and flexible connecting pipes. Thus, the bottom portion of the turret, the anchor lines, and the flexible pipes are sheltered from the destructive effects of the pack ice until the zone becomes free once more, thus enabling the ship to return to a position vertically above said turret in order to reconnect it and restart production operations.

Figure 2:
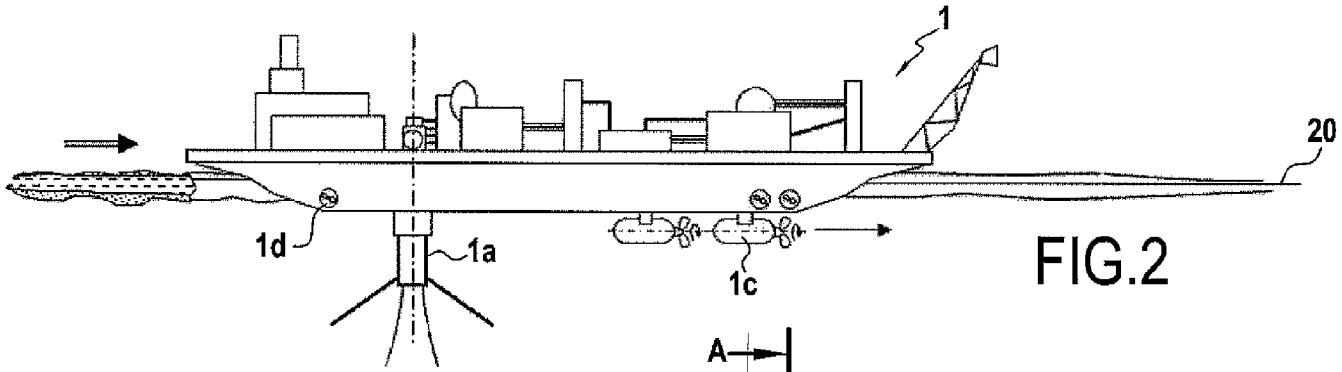
FIG. 2 is a side view, partially in section, of pack ice advancing towards the front of the FPSO.
Figure 3:
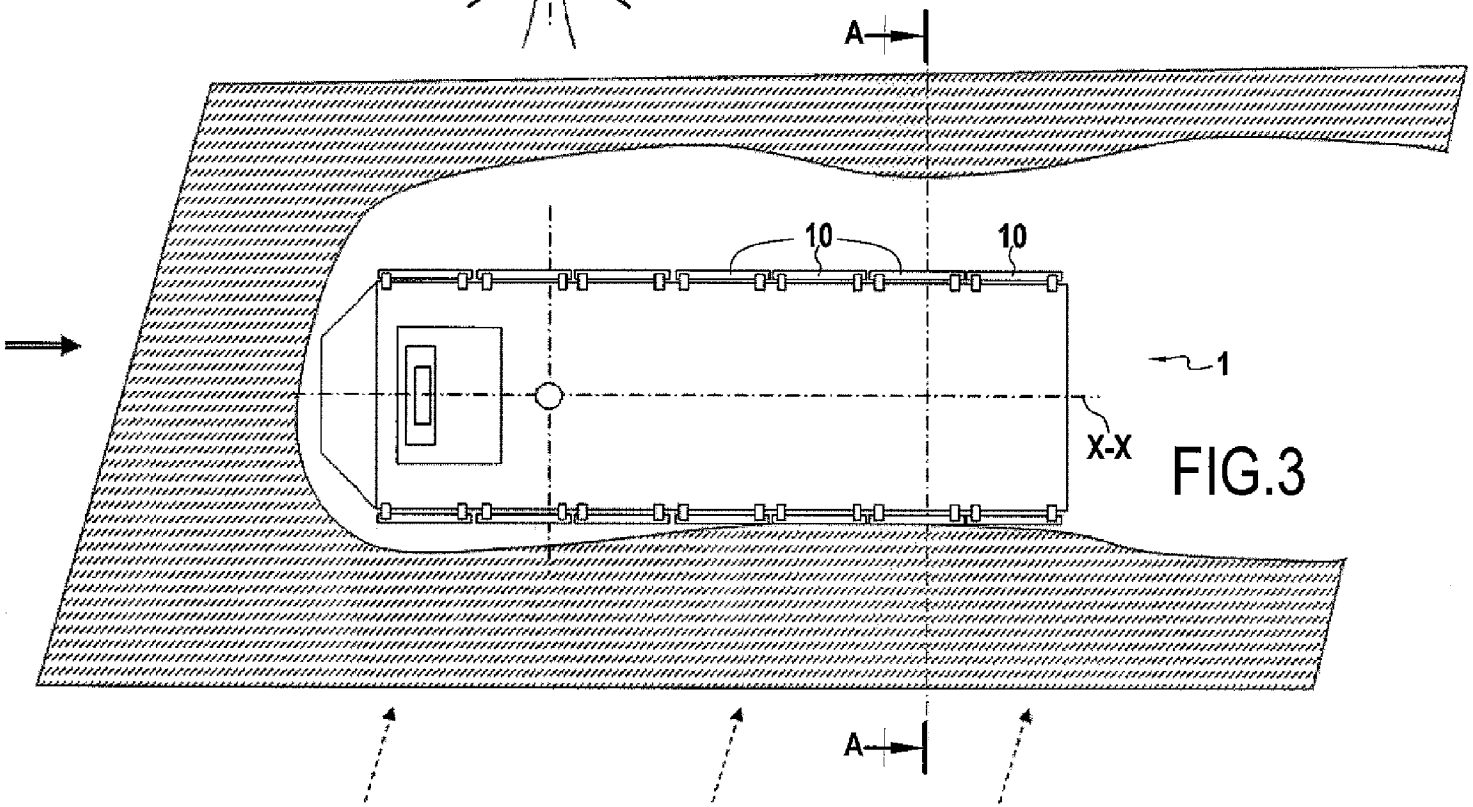
FIG. 3 is a plan view of an FPSO anchored on a turret within a channel created in pack ice, said pack ice advancing rapidly towards the front of said FPSO and slowly towards the side thereof.

FIGS. 2 and 3 are respectively a side view, partially in section, and a plan view showing an FPSO anchored on a turret within pack ice, said pack ice advancing towards the front of said FPSO, i.e. the pack ice is moving along the longitudinal axis XX of the FPSO, and is also moving sideways a little. Pack ice is moved not only by current, but also by wind, and when the combination of those effects is substantially constant, an FPSO anchored on the vertical axis turret 1*b* pivots thereabout and naturally takes up a position in the direction of least force given that the axis of the turret is offset in known manner towards the front or bow of the ship. The FPSO thus faces the advancing pack ice and its bow is profiled to have the known shape of an ice breaker, with the ice-breaking effect than being obtained merely by the ice being caused to bend by the front of the ship presenting an angle of 20° to 45° relative to the horizontal. For this purpose, with the ship being anchored via its turret by highly prestressed anchor lines, the ship remains substantially in a position that is stationary relative to the sea bottom and as soon as the anchor system is stressed by the advancing pack ice, its stiffness increases quickly and may reach several thousand (metric) tonnes (t), e.g. 3000 t to 4000 t, thereby causing the pack ice to penetrate under the front of the FPSO and thus causing it to break as it advances. In case of need, azimuth thrusters 1*c* of the Azipod type, may be actuated at full power in order to assist the anchor system and keep the FPSO in position as the pack ice advances. When the wind or the current turns, the pack ice changes direction, as shown in FIG. 3 and then presses sideways, and because the FPSO presents substantially vertical sides or freeboards 1*b* (possibly with the exception of its waterline 20), thereby presenting an optimum hull shape for high seas, so the pack ice then comes to bear head-on directly against the side 1*b* of the ship.

In order to destroy locally the pack ice that is advancing sideways, a multiplicity of pack ice destruction devices 10 of the invention are installed along the side of the FPSO, preferably along the entire length of both of its sides, the devices serving to act locally to break and thus destroy the pack ice as it advances.

Figure 4:
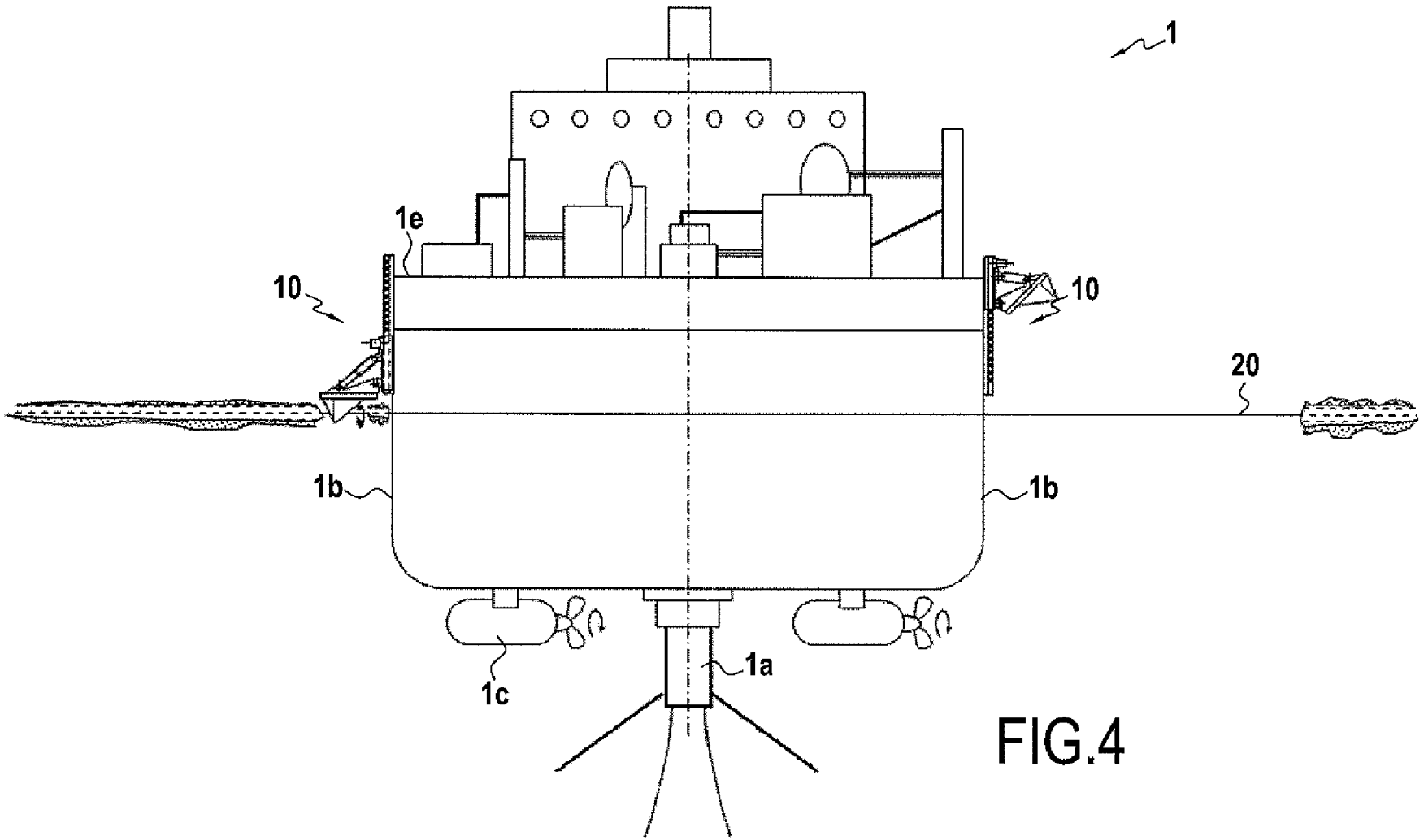
FIG. 4 is a section view of the FPSO on plane AA of FIG. 3 showing a device for destroying pack ice installed on the sides of a ship or floating support of the invention.

The destruction device of the invention is shown in FIGS. 4 and 4A to 4G. In FIG. 4, there can be seen a section on plane AA of FIG. 3 and in end view, an FPSO having substantially vertical sides and fitted on its deck, on both the port and the starboard sides, with respective hinge structures that are actuated by hydraulic actuators (not shown in FIG. 4).

The floating support 1 of the invention has seven destruction devices 10 of the invention juxtaposed side by side along the full length of each of its two sides 1*b*.

Each said destruction device 10 has two guide rails 14*a* extending vertically and parallel up the height of the side 1*b* from the top of the deck 1*e* of the floating support 1 down to immediately above the level of the pack ice 20, and preferably spaced apart by 4 m to 7 m, each rail guiding a motor-driven carriage 14*b*. Together, the two carriages carry a common tool for destroying pack ice, which tool is thus movable in vertical translation along said rails. The two carriages 14*b* are linked together and reinforced by stiffeners 15 constituted by metal girders in a crossed configuration.

The pack ice destruction tool 11 is constituted by a rigid rectangular steel platform 12, said rigid platform 12 extending over a length L lying in the range 5 m to 8 m and a width l lying in the range 3 m to 5 m.

Said platform 12 is pivotally hinged at 12*b* to the base of each of said carriages via a bracket structure beside its longitudinal side that is closest to said side of said support. An actuator 13 is supported by each carriage, said actuator being a mechanical actuator or preferably a hydraulic actuator. The actuators 13 are pivoted at 13*b* on the carriages, and more precisely the end of an actuator cylinder is pivoted near the top of a carriage, with the end of the actuator rod (suitable for being moved in translation relative to the actuator cylinder) being pivoted at 13*a* to the side of said platform that is furthest from the side of said support. Thus, actuating the actuators serve to pivot the destruction tool.

Said platform 12 supports on its underface three structures made up of steel plates 12*a* of considerable thickness, lying in the range 30 mm to 60 mm, and arranged in fours to form pyramids (cf. FIGS. 4E and 4F), and/or structures with two rectangular steel plates disposed angularly against each other to form a point, arranged at an angle of 60° to 90° one against the other, said point 11*a* extending parallel to the longitudinal direction of said platform and of said side of the support (FIGS. 4F and 4G), with the points 11*a* of either kind pointing downwards. The structures made up of thick steel plates are reinforced by internal struts interconnecting the plates.

FIG. 4F shows a combination of three pyramids arranged in a staggered configuration together with a single intermediate middle plate extending vertically and longitudinally. FIG. 4G shows a structure having two rectangular steel plates disposed angularly one against the other to form a point, the plates being at an angle of 30° to 60° to each other, and said point 11*a* extending parallel to the longitudinal direction of said platform and of the side of said support 1. The structure is terminated at its longitudinal ends by pointed structures closing the space between the two longitudinal plates.

Figure 4D:
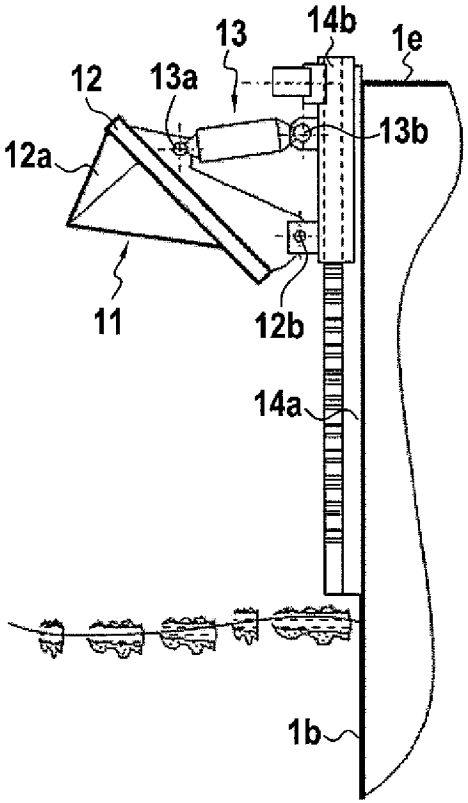
FIGS. 4B to 4D are end views of the side of a ship fitted with the destruction device of the invention as shown in FIG. 4, in an initial low position before a stage of destroying pack ice (FIG. 4B); during a stage of destroying pack ice (FIG. 4C); and in a high, storage position (FIG. 4D)
Figure 4C:
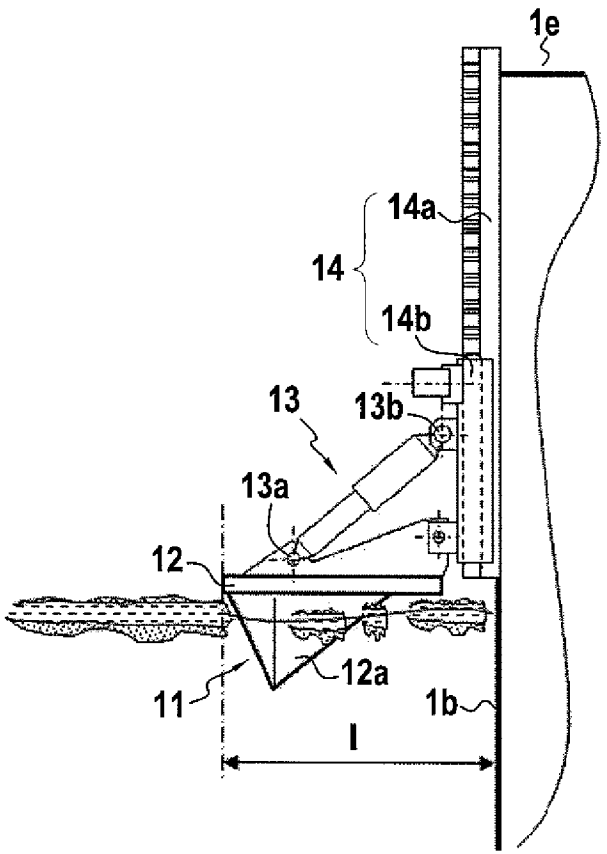
Figure 4B:
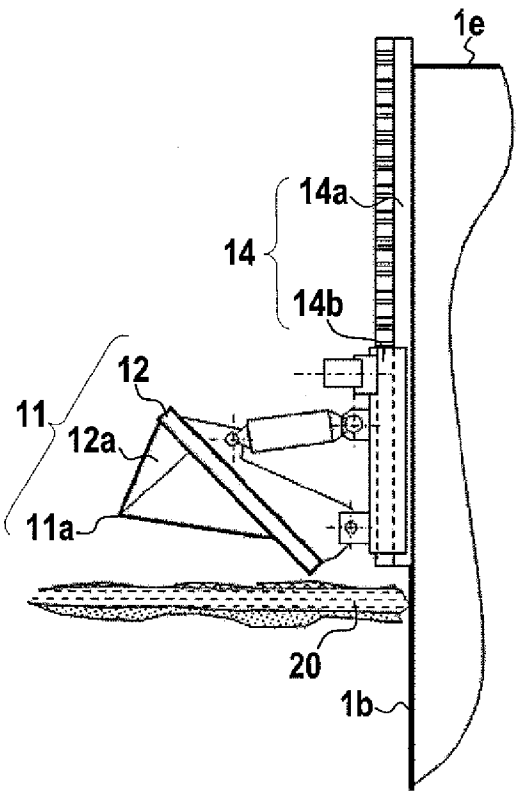

The device 10 is secured to the side of the ship, with the carriage 14*a* sliding vertically along the guide rail 14*b*, with movement being driven by a device for driving movement in translation and constituted, for example, by a rack 10*a* and a hydraulic or electric motor actuating a pinion (not shown) co-operating with said rack, so as to move the device from a high or "storage" position (FIG. 4D) vertically towards a low or "working" position (FIG. 4B). The carriage supports the tool 11 constituted by a highly stiffened platform structure 12 having an underface supporting pointed structures 12*a*, being hinged at 12*b* and actuated by two actuators 13 that are themselves pivoted to said carriage 13*b* and to said structure at 13*a*. By retracting the actuators 13, the tool 11 comprising the structure 12 & 12*a* returns to the raised position as shown in FIG. 4, in the storage position, and similarly, by deploying the actuators 13, the tool 11 reaches the deployed position shown in FIG. 4C. The pointed structure 12*a* may penetrate into the pack ice and break it, by impact or by bending, with the structure being actuated to pivot from its retracted position its deployed position. Thus, when the pack ice approaches a side of the FPSO laterally, e.g. its port side, all of the devices 10 initially in the storage position as shown in FIG. 4D, are lowered to the low level, with their platforms 12 still being the raised position. The carriages are then locked in the low position by a device that is not shown, and each of the tools 11 is actuated so as to deploy the platforms 12 carrying the ice-breaking structures 12*a* on their underfaces, which structures penetrate several meters into the pack ice, thereby destroying it over a length L corresponding to the length of the device 10, as shown in FIG. 4A. In order to limit the total hydraulic power needed and in order to deploy the tool 11 rapidly, it is advantageous to actuate the devices 10 in succession, one after another, as shown in FIGS. 5B and 5C, and as explained in greater detail below.

Figure 5B:
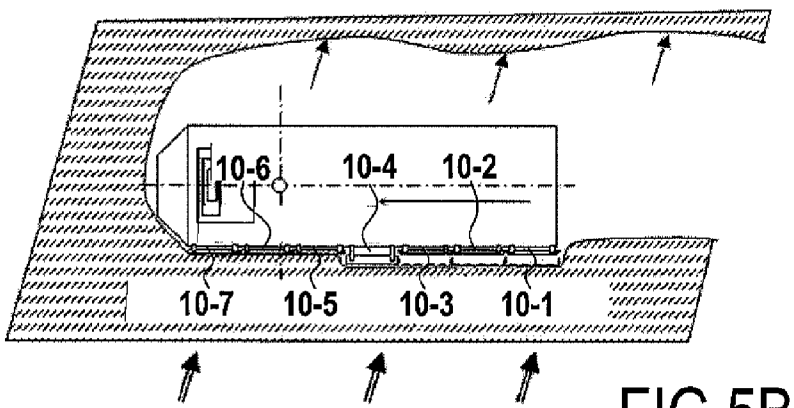
FIGS. 5A to 5D are plan views of an FPSO surrounded by pack ice, for describing the process of localized destruction of pack ice by the device of the invention.
Figure 5D:
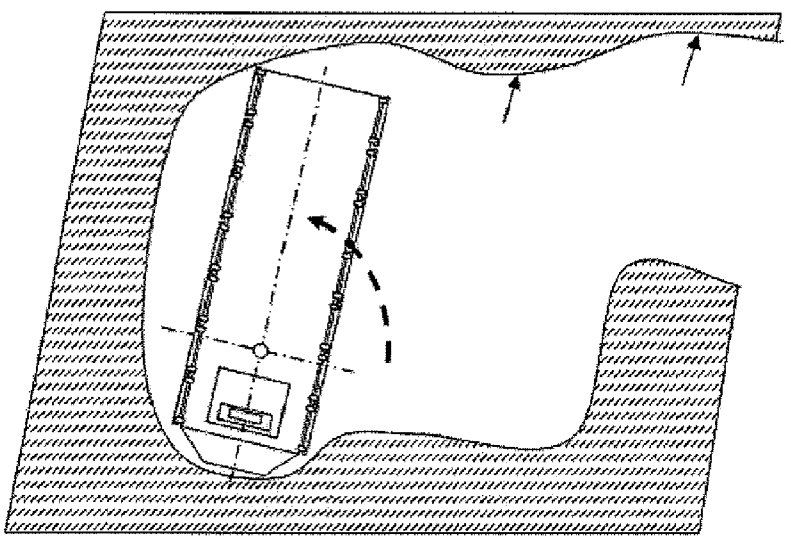
Figure 5A:
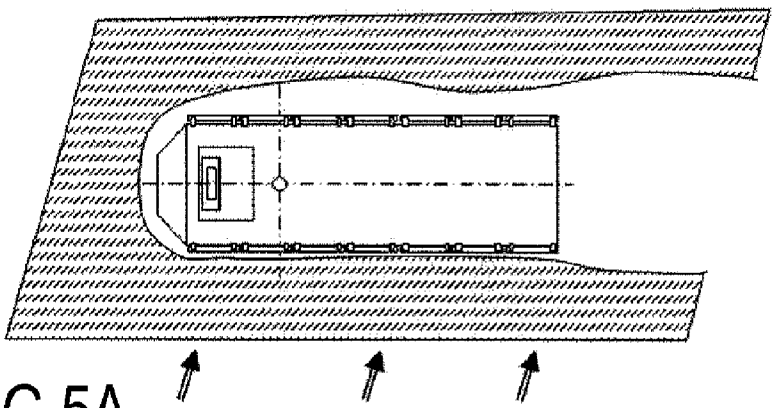
Figure 5C:
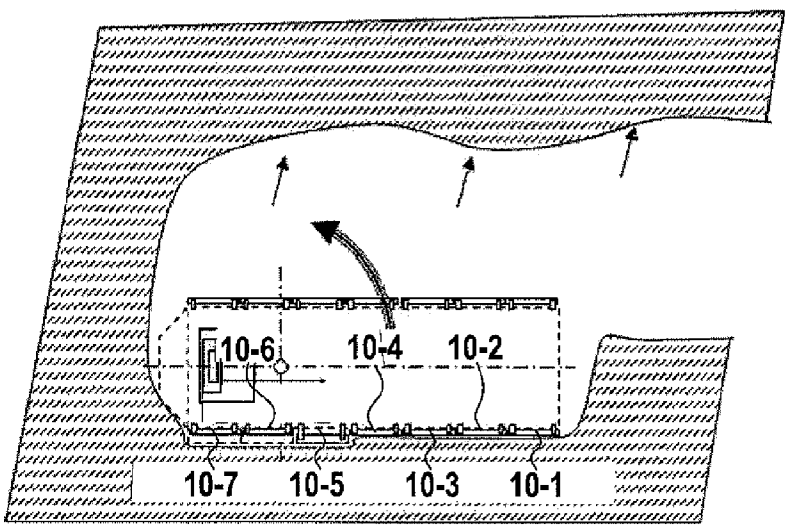

FIGS. 5A-5D are plan views showing the pack ice destruction process that enables the FPSO to return to a head-on position facing the advance of said pack ice. In FIG. 5A, the head-on progress of the pack ice from left to right has stopped and the pack ice is now moving upwards in the figure as shown by arrows. The pack ice then comes into contact with the side of the FPSO. In FIG. 5B, the device of the invention is actuated sequentially so as to destroy the pack ice piece by piece in segments having a length of 7.5 m corresponding to the length L of an individual device put into action. The successive devices are operated one after another, e.g. starting from the stern of the FPSO, and going towards its bow, thereby acting on each occasion to release a portion of pack ice that is about 7.5 m long and about 3 m to 5 m wide, depending on the reach of said device. In FIG. 5B, the devices 10-1, 10-2, and 10-3 have been deployed, the device 10-4 is being deployed, and the devices 105, 10-6, and 10-7 are waiting to be deployed, one by one and in sequence. In FIG. 5C, all of the devices have been deployed from the stern towards the bow, and they are now deployed from bow towards the stern in sequence: the devices 10-7 and 106 are deployed, and the device 105 is being deployed. During this stage, the FPSO is preferably maintained parallel to the destruction front by the azimuth thrusters 1*c* and by the bow thrusters 1*d* incorporated in the hull of said FPSO, as shown in FIG. 1, with the effect of said azimuth thrusters and said bow thrusters producing an intense current that serves, in known manner, to expel the debris from the pack ice that has just been broken up. After multiple cycles of destroying the pack ice, the pack ice will have moved far enough upwards in the figure, as shown in FIG. 5D, for it to be possible to turn the ship without the stern of the FPSO, having an ice-breaker shape like the bow, significantly interacting with the pack ice. Thus, with the help of its azimuth thrusters and possibly also its bow thrusters, the FPSO then pivots about its anchor turret and returns to a head-on position facing the advance of the pack ice. The reinforced stem of the FPSO, shaped like an ice breaker, in association with the rigidity of the anchor system, once more naturally breaks the pack ice as it advances in the axial direction of said FPSO. All of the pack ice destruction devices are then retracted and put into the storage position, as shown with reference to FIG. 4D, thereby releasing the sides of the ship.

The device of the invention is described above with carriages that move vertically, supporting actuators that are pivoted in order to break the pack ice, with the extreme force being created during the pivoting stage, however it would remain within the spirit of the invention if the destruction tool were initially deployed by actuating its actuators in pivoting, with the ice-breaking force then being created by movement in translation with the destruction device moving downwards towards and through the pack ice.

The arrangement of the hydraulic actuators may be modified in the manner known in the field of earthmoving plant, such as for actuating the arms of hydraulic shovels.

The invention claimed is:

1. A floating support having a hull for off-shore oil production in an arctic or antarctic zone, the support being fitted under its hull with a disconnectable turret from which there extend anchor lines to the sea bottom and bottom-to-surface connection pipes, said hull including longitudinal lateral sides extending in its longitudinal direction (XX), wherein said longitudinal lateral sides carry respective pluralities of devices for localized destruction of pack ice, each device comprising a destruction tool having at least one pointed portion comprising a rigid structure suitable for breaking pack ice by repeated actuation in one of a vertical pivoting and a translation of said tool relative to said longitudinal lateral side, said point, on moving downwards, thus bearing in localized manner against the surface of the pack ice with a force capable of breaking the ice over its entire thickness by bending, at least after a series of repeated downward and upward actuations, said tool being actuated in said one of the pivoting and translation with the help of a pivoting and/or translation guide structure applied against the longitudinal lateral side of the support.

2. The floating support according to claim 1, further comprising a multiplicity of destruction devices on both of its longitudinal sides, the destruction devices being juxtaposed side by side over substantially the entire length of said sides.

3. The floating support according to claim 1, wherein said pack ice destruction device comprises means for guiding and moving the destruction tool in vertical translation over the height of the side between a storage position above the level of pack ice and a, working position below said storage position, and means for actuating downward and upward pivoting of the destruction tool between the surface of the side and the surface of the pack ice so that pivoting of said tool enables the tool to reach a sufficient depth to pass through the entire thickness of the pack ice, at least after a series of repeated downward and upward actuations in pivoting.

4. The floating support according to claim 1, wherein actuating said destruction tool enables a force of at least 1000 kN to be applied to the surface of the pack ice and enables the pack ice to be broken over its entire thickness by bending over a length lying in the range 3 m to 15 m.

5. The floating support according to claim 1, wherein the destruction tool comprises a rigid platform extending longitudinally and substantially horizontally along the side of the support over a length lying in the range 3 m to 15 m, and having a width of 2 m to 5 m, and supporting on its underface a plurality, of said pointed rigid structures disposed side by side and secured to said platform.

6. The floating support according to claim 1, wherein said pointed rigid structure is constituted by steel plates, disposed at an angle relative to one another of 30° to 120.

7. The floating support according to claim 6, wherein said pointed rigid structure is constituted by three steel plates disposed as a trihedron or by four steel plates disposed as a pyramid.

8. The floating support according to claim 7, wherein said pointed rigid structure is constituted by two rectangular steel plates disposed at an angle one against the other.

9. The floating support according to claim 3, wherein said pack ice destruction device includes a guide structure for guiding the destruction tool in translation and in pivoting, the guide structure comprising at least one carriage, suitable for moving vertically in translation along at least one guide rail, said carriage supporting at least one actuator, with the end of the actuator cylinder being pivotally hinged to said carriage, said tool being supported and pivotally hinged firstly to said carriage, and secondly to the end of the actuator rod, such that said tool may be stored together with the carriage in said storage position above the level of the pack ice, said actuator being in a retracted position and said carriage being capable of being moved down in translation to the working position, and of being blocked in said working position so that extending said actuator causes said destruction tool to pivot, said point(s) being capable of reaching a sufficient depth to pass through the entire thickness of the pack ice when the actuator rod is fully extended.

10. The floating support according to claim 9, wherein said carriage includes gearing driven by an electric or hydraulic motor and co-operating with a guide rail of the rack type.

11. The floating support according to claim 9, wherein said destruction device has two guide rails extending vertically and in parallel over the height of the side from above the deck of the floating support to immediately above the level of the pack ice, each guiding a motor-driven carriage, the base of the carriage having pivotally hinged thereto a said platform on its longitudinal side closest to said side of the support, and said storage portion having an end of a hydraulic actuator cylinder pivotally hinged thereto, the end of the actuator rod being pivotally hinged to said platform, close to the side of the platform that is furthest from said side of the support.

12. A method of destroying a pack ice using a floating support according to claim 1, wherein the various destruction devices along the length of the side of the floating support facing the pack ice are actuated.

13. The method of destroying pack ice according to claim 12, wherein the various destruction devices disposed side by side are actuated successively one after another sequentially along the length of the side facing the pack ice.

14. The method according to claim 12, wherein said floating support is fitted with azimuth thrusters and with bow thrusters that are used to cause the floating support to turn so that it takes up a position facing the pack ice head-on once sufficient pack ice has been destroyed with said destruction devices to enable the floating support to be received in a channel thus created.

* * * * *